United States Patent [19]

Reist

[11] 4,420,146

[45] Dec. 13, 1983

[54] APPARATUS FOR OPENING FOLDED, BOUND OR STITCHED MULTI-SHEET PRODUCTS, ESPECIALLY PRINTED PRODUCTS

[75] Inventor: Walter Reist, Hinwil, Switzerland

[73] Assignee: Ferag AG, Hinwil, Switzerland

[21] Appl. No.: 214,461

[22] Filed: Dec. 8, 1980

[30] Foreign Application Priority Data

Jan. 5, 1980 [CH] Switzerland ..... 304/80

[51] Int. Cl.[3] ..... B65H 5/30

[52] U.S. Cl. ..... 270/55; 270/57

[58] Field of Search ..... 270/55, 57; 271/280–281

[56] References Cited

U.S. PATENT DOCUMENTS

| | | | |
|---|---|---|---|
| 3,561,751 | 2/1971 | Dutro | 270/57 |
| 3,722,877 | 3/1973 | Wetter | 270/57 |
| 3,951,399 | 4/1976 | Reist | 270/55 |

*Primary Examiner*—A. J. Heinz

*Attorney, Agent, or Firm*—Werner W. Kleeman

[57] ABSTRACT

The folded printed product to be opened is moved with its open side leading towards a stationary separation element. The separation element contains a flat, tongue-like opening element attached to a shaft extending transversely with respect to the direction of movement of the printed product. The opening element is rotatable by means of this shaft. In its starting position the opening element is directed with its pointed end towards the arriving printed product. By means of this pointed end the opening element penetrates between the sheets of the printed product. Thereafter the shaft together with the opening element is rotated in a predetermined direction, for instance in the counterclockwise direction, while there is continued the feed movement of the printed product. Due to such rotation of the opening element the part of the printed product reposing thereon is raised from the other product part, so that the printed product is opened. During the course of the further movement of the printed product a stationary hold-open element moves between the opened parts of the printed product, to thereby prevent closing of the opened printed product. Further printed products can be stuffed into the printed product which is held in its open condition. As soon as the opened printed product has completely moved past the separation element, the opening element again is turned back or rotated into its starting position.

15 Claims, 6 Drawing Figures

APPARATUS FOR OPENING FOLDED, BOUND OR STITCHED MULTI-SHEET PRODUCTS, ESPECIALLY PRINTED PRODUCTS

CROSS-REFERENCE TO RELATED APPLICATION

This application is related to the commonly assigned copending U.S. application Ser. No. 06/214,460, filed Dec. 8, 1980 now U.S. Pat. No. 4,398,710.

BACKGROUND OF THE INVENTION

The present invention relates to a new and improved method of, and apparatus for, opening folded, bound or stitched multi-sheet products, especially printed products.

Generally speaking, the method and apparatus of the invention contemplates that the product which is to be opened is moved with a leading open side thereof towards a stationary separation element which moves between the sheets of the product and the printed product is moved past such stationary separation element.

There are already known to the art different opening devices for printed products, by means of which, with the aid of a pre-separator element, the sheets of the product or article being processed are separated from one another at a certain region thereof. Thereafter, a separator element is introduced into the thus formed gap, to thereby assume the task of completely opening the product. According to one prior art construction of such product or article opening apparatus, as the same has been disclosed in German Patent Publication No. 2,447,336 and the corresponding U.S. Pat. No. 3,951,399, the pre-separator element is a pressure element which exerts a compressive force at the folded product, this force being directed transversely to the flat side of such product. As a result there is caused bowing-out of part of the sheets. Into the thus formed gap there is introduced a separator or separation element which completely opens the product. Since the mode of operation of this equipment is predicated upon the presence of a pre-bias or pre-stress in the product which is governed by the folding of the product, it is only possible to open certain types of products with this technique. Additionally, during the pre-separation operation the gap forms between the sheets located at opposite sides of the fold, so that there is not readily possible opening of the product at a different location.

Additionally, this type of product opening apparatus, along with all others working with the technique of carrying out a pre-separation and subsequent actual separation, have common thereto the drawback that the construction of the equipment is quite complicated.

Apart from the foregoing constructions there are known to the art other product or article handling apparatuses such as exemplified by U.S. Pat. Nos. 3,580,562, 3,692,301 and 3,722,877.

SUMMARY OF THE INVENTION

It is a primary object of the present invention to provide a new and improved method of, and apparatus for, opening folded, bound or stitched multi-sheet products, especially printed products, in a manner not associated with the aforementioned drawbacks and limitations of the prior art proposals heretofore discussed.

Another and more specific object of the present invention aims at providing a new and improved method of, and apparatus for, opening multi-sheet products or articles, especially printed products, wherein it is possible to open with very simple means such folded, stitched or bound multi-sheet products in a faultless manner independent of their thickness at a freely determinable location, without there arising the danger of damaging the product.

Now in order to implement these and still further objects of the invention, which will become more readily apparent as the description proceeds, the method aspects of the present development are manifested by the features that the product containing the sheets bearing practically completely upon one another is moved towards an essentially flat opening element of the separation element. After penetration of the opening element between the sheets of the product the opening element is rotated or turned so that the sheets reposing upon one side of the opening element are raised from the remaining sheets of the thus processed product.

As alluded to above the invention is not only concerned with the aforementioned method aspects, but also relates to a new and improved construction of apparatus for opening such products wherein the separation element contains an essentially flat, rotatable opening element which penetrates between the product sheets which bear practically completely upon one another. By subsequently rotating the opening element it is possible to raise the sheets lying upon one side of the opening element from the remaining sheets of the product.

The product which is to be opened is moved with an open side towards the opening element and past such opening element, which thus piercingly penetrates at the desired location between the product sheets which practically completely bear upon one another. Through subsequent rotation of the opening element, preferably about an axis extending transversely with respect to the direction of movement of the product, part of the sheets are raised from the remaining part. During the further movement of the product the latter is held open by the opening element as long as this opening element is located between the product sheets. Preferably, behind the separation or separating element there is arranged a hold-open element which is introduced into the opened product so that the opening element again can be moved back into its starting position. With the aid of a single separation element it is possible to obtain a complete opening of the product. By appropriately constructing the opening element it is possible, on the one hand, to extensively avoid damage to the product, and on the other hand, it is possible to determine in a faultless manner the separation location independently of the thickness of the product.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
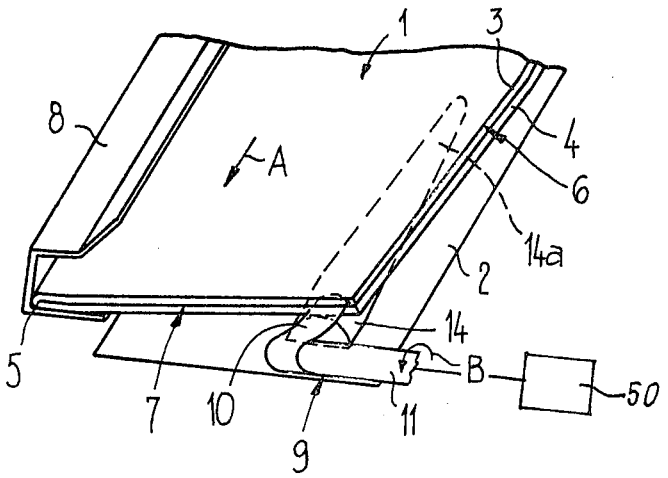
FIG. 1 is a perspective view of an opening apparatus for printed products according to the invention.

Describing now the drawings, as illustrated, the printed product or article 1 which is to be opened bears at a flat side thereof upon a support 2. This support or mounting element is, for instance, a partition wall which separates the radially extending compartments of a cell wheel from one another, as the same has been described in greater detail in the aforementioned U.S. Pat. No. 3,951,399, to which reference may be readily had and the disclosure of which is incorporated herein by reference. The multi-sheet printed product 1 is folded and possesses two parts 3 and 4 which are interconnected by means of the fold 5 (the so-called spine). The sides neighboring the fold 5, of which there has only been shown the leading side 7, are likewise open. As best seen by referring to FIG. 1, the printed product 1 along with its fold 5 bears at the base portion of a holder or holder member 8 which is essentially of C-shaped configuration in cross section. The C-shaped holder or holder member 8 can be moved in any suitable manner in the direction of the arrow A. By means of likewise not here shown gripper jaws the printed product 1 is pressed against the holder or holder member 8. As to details of a possible construction of the holder 8 and the aforementioned gripper jaws as well as the mode of operation of the feed drive for the holder 8 and the printed product 1, reference may be had to German Patent Publication No. 2,604,101 and the corresponding U.S. Pat. No. 4,058,202.

As particularly well seen by referring to FIGS. 2 to 6, arranged along the path of movement of the printed product 1 is a stationary product separation or divider element 9. The separation or divider element 9 will be seen to comprise a flat, substantially tongue-shaped opening element 10 which is pointed at one end 10*a* and at its other end is guided about a stationary shaft 11 and is connected with this shaft 11 by any suitable attachment element 12, for instance a threaded bolt or screw. The shaft 11 is connected with a suitable and thus merely schematically illustrated control mechanism 50 which, in a manner to be more fully described hereinafter causes rotation of the shaft 11 together with the opening element 10. Viewed in the direction of movement A of the printed product 1 there is arranged behind the separation element 9 a substantially wedge-shaped configured hold-open element 13, the function of which will be explained more fully hereinafter.

Arranged forwardly of the separation element 9 is a substantially wedge-shaped ramp 14 which is connected with the support 2. The ramp or ramp member 14 possesses a run-on surface 14*a* for the printed product 1, this run-on surface 14*a* extending in a direction towards the separation element 9.

With reference now being had to FIGS. 2 to 6 there will be explained the product opening operation.

Figure 2:
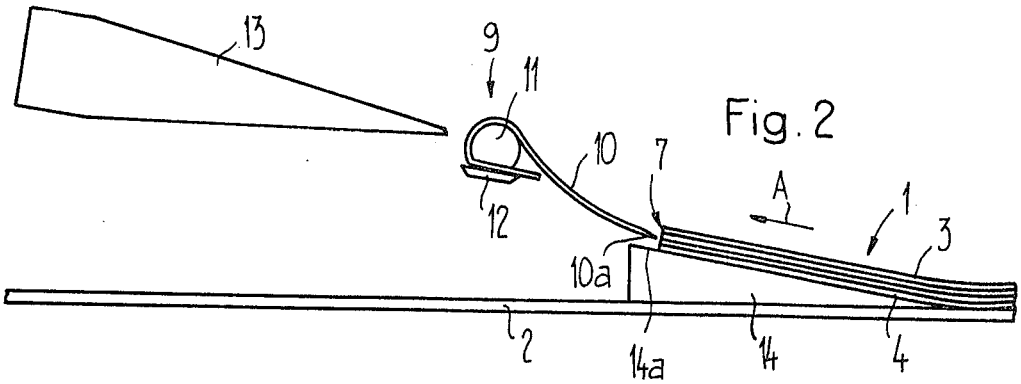
FIGS. 2, 3, 4, 5 and 6 respectively show on an enlarged scale in relation to the illustration of FIG. 1, the apparatus of FIG. 1 in side view and during different phases of the opening operation.
Figure 3:
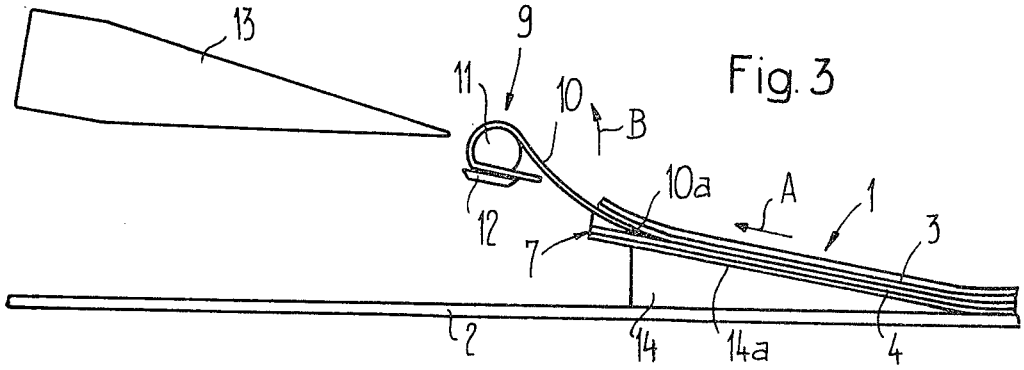

In its starting position illustrated in FIGS. 1, 2 and 3, the opening element 10 is directed with its tip 10*a* towards the arriving printed product 1. Such printed product 1 is moved with its open side 7 leading in the direction of the arrow A towards the opening element 10 which is located in its starting position. As a result, the printed product 1 travels on the run-on surface 14*a* of the ramp member or ramp 14, and thus, is guided in the direction of the opening element 10, as best seen by referring to FIG. 2. During the further forward movement of the printed product 1 the opening element 10 is inserted by means of its tip 10*a* between the sheets of the printed product 1. As best seen by referring to FIG. 3, with the illustrated exemplary embodiment, this insertion of the tip 10*a* of the opening element 10 into the product sheets occurs between the portions 3 and 4, i.e. approximately at the center of the printed product 1. As will be recognized by referring to FIGS. 2 and 3, by adjusting the spacing between the run-on surface 14*a* and the tip 10*a* of the opening element 10 which is located in its starting position, it is possible to beneficially exactly determine the insertion location of the opening element 10. Due to the provision of the pointed tip-like end 10*a* of the opening element 10 there is extensively avoided any damage to the sheets upon insertion of the opening element 10 into the printed product 1. After completion of the insertion operation of the opening element 10 the shaft 11, and along therewith also the opening element 10, are rotated in counterclockwise direction as indicated by the arrow B of FIG. 3, and specifically, about an axis of rotation which is substantially parallel to a plane defined by the product to be opened.

Figure 4:
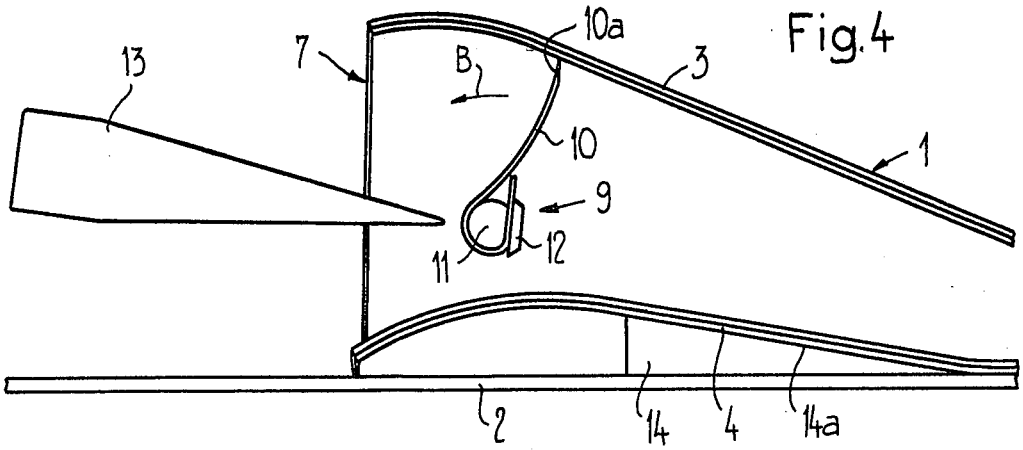

Due to this rotation the sheets of the product part or portion 3 which are lying upon the opening element 10 are raised as will be particularly evident by referring to FIG. 4. Due to raising of the sheets of the product part 3 both parts 3 and 4 are separated from one another and the printed product 1 therefore is opened at its central region. During this rotational movement of the opening element 10 in the direction of the arrow B the printed product 1 is further moved forwards in the direction of the arrow A, so that the opening element 10, located between the product parts 3 and 4, ensures that the printed product 1 will be held open.

Figure 5:
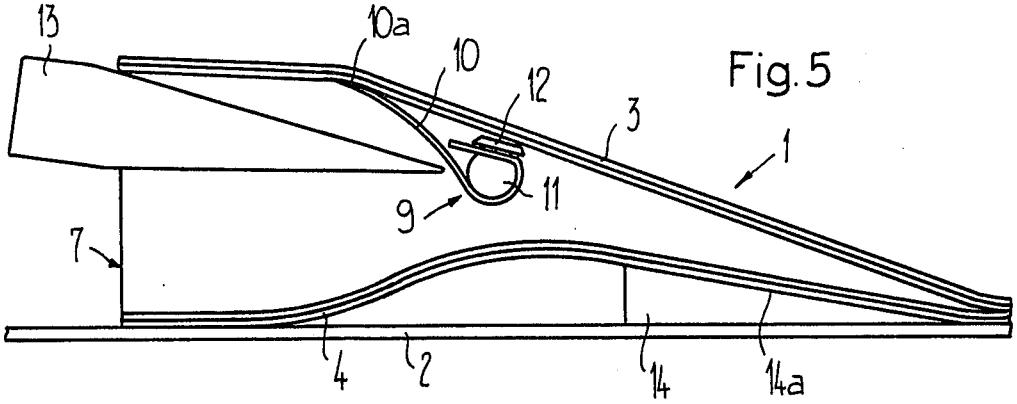
Figure 6:
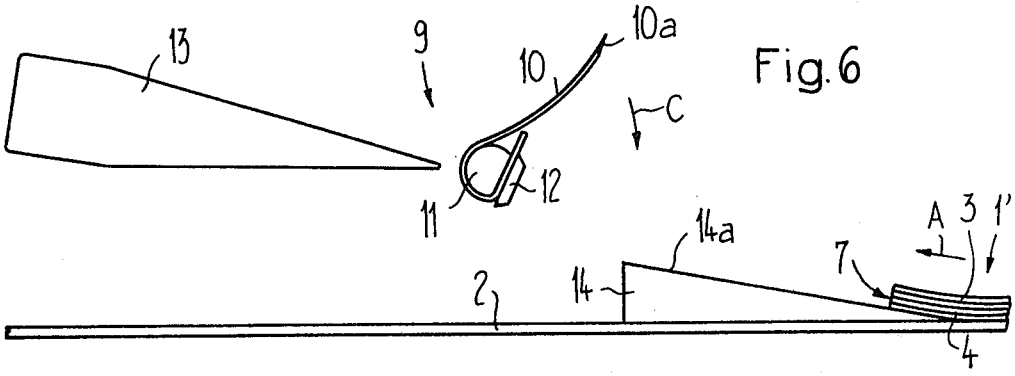

In FIG. 5 the opening element 10 has been shown in its end or terminal position, which it is reached, starting from the starting position, after it has been rotated through an angle of about 180°. During this pivotal movement of the opening element 10 into the end of terminal position, the printed product 1 has been forwardly shifted to such an extent that the stationary hold-open element 13 engages between the product parts 3 and 4 which have been raised or spaced from one another. This hold-open element 13 has assigned to it exclusively the function of preventing any closing of the product 1 after it has been opened by the opening element 10. Now it is possible to stuff or insert, for instance, further printed products into the printed product 1 which is retained in its open position by the hold-open element 13, as such stuffing operation has been described in greater detail in the aforementioned U.S. Pat. No. 3,951,399. As soon as the opened printed product 1 has completely moved past the separation element 9, then the opening element 10 is again turned back by the control mechanism 50, in the clockwise direction in the direction of the arrow C, out of the end position back into the starting position as best seen by referring to FIG. 6. This starting position is reached before the next printed product 1' which is to be opened arrives directly in front of the separation element 9. Now there is again carried out the previously described opening operation.

Instead of moving, as described, the opening element 10 in the opposite direction from the end position back into the starting position, it is of course also possible to further rotate the opening element 10 in the same direction, i.e. likewise in the direction of the arrow B, from the end or terminal position back into the starting position.

Based upon the FIGS. 1 to 6 there previously was explained the opening of a product without any pre-fold. However, in the same manner it is possible to open printed products containing a pre-fold, at which, for instance, the part 4 protrudes at the side 6 past the part 3.

As has been explained in conjunction with FIG. 1, the opening element 10 engages between the product sheets at the side 7 which extends transversely with respect to the fold 5. The described opening operation can be, however, also carried out in corresponding manner if the printed product is moved with the open side 6 leading and located opposite the fold 5 towards the separation element 9. Since in this case the separation element 9, during the movement of the printed product therepast, bears at the fold 5, there will be needed a suitable device for moving the separation element 9 transversely with respect to the movement direction A of the printed product out of such path of movement before the fold 5 of the printed product will arrive at the region of the separation element 9.

With the described opening apparatus it is not only possible to open, as illustrated, the printed products at their center, rather at any other random freely selectable location. This can be obtained by an appropriate setting of the starting position of the opening element 10. By means of such setting or adjustment there also can be carried out accommodation of the equipment to the most varying thicknesses of printed products which are to be processed.

It should be understood that apart from handling printed products of any type with the described equipment, it is also possible to open other multi-sheet articles or products which are folded, stitched or bound i.e. where the sheets are interconnected with one another at least at one side.

Although the described opening apparatus can be employed in the most different ways, it is particularly suitable for use in conjunction with equipment for processing folded, bound or stitched multi-sheet printed products, wherein such equipment contains a cell wheel revolving about a shaft or axis, such as for instance disclosed in the aforementioned U.S. Pat. No. 3,951,399 and U.S. Pat. No. 4,058,202. Such cell wheel contains radially extending compartments for receiving the printed products, in which the printed products are moved in the direction of the axis of rotation of the cell wheel. Preferably, in the individual compartments of the infeed section of the cell wheel there is arranged in each case one such type opening apparatus.

While there are shown and described present preferred embodiments of the invention, it is to be distinctly understood that the invention is not limited thereto, but may be otherwise variously embodied and practiced within the scope of the following claims.

What I claim is:

1. An apparatus for opening folded, bound or stitched multi-sheet products of a generally planar configuration, especially printed products, comprising:

a separation element capable of being introduced between the sheets of a respective product as a relative movement is effected between the product and the separation element, whereby an open side of the product is displaced past the separation element at a leading open side of such product;

means for accomplishing relative movement between the product and the separation element;

said separation element comprising an essentially flat, rotatable opening element;

means for rotating said rotatable opening element about an axis of rotation which is substantially parallel to a plane defined by the product to be opened;

said rotatable opening element piercingly entering between the sheets of the product which practically completely bear upon one another; and said rotating means including means mounting said opening element in a position relative to the product such that said opening element, when subsequently rotated after it has piercingly entered the sheets of the product, separates the sheets located at one side of the opening element from the remaining sheets of the product.

2. The apparatus as defined in claim 1, wherein:

said apparatus is employed for opening of products composed of sheets interconnected with one another at only one side thereof and wherein such products move in a direction parallel to a fold or spine of such products.

3. The apparatus as defined in claim 1, wherein:

said means for accomplishing said relative movement moves said product in a predetermined direction of movement; and said mounting means mounting said separation element in a spatially fixed position.

4. The apparatus as defined in claim 1, wherein:

said means for rotating said opening element comprises a rotational shaft;

said rotational shaft extending transversely with respect to said direction of movement of the product; and said opening element, in a starting position thereof, being directed towards the arriving product.

5. The apparatus as defined in claim 4, wherein:

said rotational shaft extends approximately at right angles to the direction of movement of the product.

6. The apparatus as defined in claim 4, wherein:

said means for rotating said opening element pivots same out of a starting position, through an angle of about 180°, into a terminal position.

7. The apparatus as defined in claim 3, further including:

means defining an ascending run-on surface for the product; and said run-on surface being arranged upstream of the separation element with respect to said predetermined direction of movement of the product and ascending in the direction of movement of the product towards the opening element.

8. The apparatus as defined in claim 3, further including:

a hold-open element arranged downstream of the separation element with respect to said predetermined direction of movement of the product and engaging between the product sheets which have been raised from one another; and said opening element, following insertion of the hold-open element into the opened product, being rotated back into a starting position thereof.

9. The apparatus as defined in claim 1, wherein:

said opening element has an end which is pointed and confronts the arriving product.

10. The apparatus as defined in claim 1, wherein:

said mounting means for said opening element comprises a shaft; and said opening element being formed by a tongue member secured to such shaft.

11. An apparatus for processing folded, bound or stitched multi-sheet printed products of a generally planar configuration, comprising:

a cell wheel rotatable about a predetermined axis of rotation;

said cell wheel containing radially extending compartments for receiving the printed products;

said printed products being moved within the compartments in the direction of the axis of rotation of said cell wheel;

each of said compartments having a product infeed portion;

the product infeed portion of each individual compartment of the cell wheel being provided with a device for opening said printed products;

said product opening device comprising:

a separation element capable of being introduced between the sheets of a product which is moved past the separation element at a leading open side of such product;

said separation element comprising an essentially flat, rotatable opening element;

means for rotating said rotatable opening element about an axis of rotation which is substantially parallel to a plane defined by the product to be opened;

said rotatable opening element piercingly entering between the sheets of the product which practically completely bear upon one another; and said rotating means including means mounting said opening element in a position relative to the product such that said opening element, when subsequently rotated after it has piercingly entered the sheets of the product, separates the sheets located at one side of the opening element from the remaining sheets of the product.

12. A method of opening folded, bound or stitched multi-sheet products of a generally planar configuration, especially printed products, comprising the steps of:

providing a product separation element having an essentially flat opening element;

relatively moving the product separation element and the printed product with a leading open side thereof, while the sheets of the printed product practically completely bear upon one another, in a direction of the essentially flat opening element of the separation element and past said essentially flat opening element;

inserting the opening element between the sheets of the printed product during the course of said relative movement; and following such insertion of the opening element rotating the opening element about an axis extending in a direction substantially parallel to a plane defined by the printed product while at least a part of the sheets of the printed product bear against such rotating opening element, so that the sheets of the printed product located at one side of the opening element are separated from the remaining sheets of the printed product.

13. The method as defined in claim 12, wherein:

said axis of rotation is stationary and the relative movement is effected by displacing said product in a predetermined direction of movement towards said opening element.

14. The method as defined in claim 13, further including the steps of:

positioning the opening element such that in a starting position thereof it is directed towards the arriving product; and rotating the opening element about an axis extending transversely with respect to said predetermined direction of movement of the product.

15. An apparatus for opening folded, bound or stitched multi-sheet products, especially printed products, comprising:

a separation element capable of being introduced between the sheets of a product which is moved in a predetermined direction of movement past the separation element at a leading open side of such product;

said separation element comprising an essentially flat, rotatable opening element;

means for rotating said rotatable opening element;

said rotatable opening element piercingly entering between the sheets of the product which practically completely bear upon one another;

said rotating means including means mounting said opening element in a position relative to the product such that said opening element, when subsequently rotated after it has piercingly entered the sheets of the product, separates the sheets located at one side of the opening element from the remaining sheets of the product;

means defining an inclined run-on surface for the product; and said run-on surface being arranged upstream of the separation element with respect to said predetermined direction of movement of the product to divert the product to a path inclined with respect to the predetermined direction for directing the product towards the opening element.

* * * * *